United States Patent [19]

Vogt

[11] 4,151,533

[45] Apr. 24, 1979

[54] ANTENNA MOUNT

[76] Inventor: Russell A. Vogt, 6091 Cochise, West Bloomfield Hills, Mich. 48033

[21] Appl. No.: 829,772

[22] Filed: Sep. 1, 1977

[51] Int. Cl.[2] ..... H01Q 1/32
[52] U.S. Cl. ..... 343/715; 248/539
[58] Field of Search ..... 343/711, 712, 713, 715, 343/880, 881; 248/539

[56] References Cited

U.S. PATENT DOCUMENTS

| | | | |
|---|---|---|---|
| 4,035,806 | 7/1977 | Powell | 343/715 |
| 4,114,159 | 9/1978 | Verini | 343/715 |

*Primary Examiner*—Eli Lieberman
*Attorney, Agent, or Firm*—Edward G. Jones

[57] ABSTRACT

A combination of components for mounting a receiving and transmitting antenna, especially a CB antenna, on a conveyance, especially a motor vehicle, so that the components are easily adjusted and locked in assembled relationship for use and also easily separable for safe concealment during storage.

4 Claims, 4 Drawing Figures

ANTENNA MOUNT

BACKGROUND OF THE INVENTION

1. Field of the Invention

This invention relates to the field of devices suited for alternate putting into service and into storage, especially devices for mounting transceiving antennas, and more specifically to such mounting devices which are readily placed in assembled relationship for use proximal to but outside a conveyance and readily disassembled for non-visible storage inside a conveyance such as an automobile.

2. Prior Art Statements

Technology in the area of receiving and transmitting waves carrying radio messages and broadcasts has progressed to a point which has greatly enlarged the field of use beyond the official and semiofficial areas. With the allotment of certain designated bands or sets of frequencies for civilian use a need has arisen for simple, economical and efficient equipment which permits civilians to enjoy use of these designated frequencies as for example in their personal conveyances such as automobiles. Personal use of the designated frequencies provides desirable voice contact in usual situations such as for meetings, appointments, announcements and the like and in unusual circumstances such as accidents, fire and police emergencies, traffic problems and the like.

Both extrinsic and intrinsic difficulties and problems associate themselves with most technological advances. The area of civilian and personal use and enjoyment of developments in radio frequency transmission and receiving is not free of such serious and disturbing difficulties. Extrinsically, vandalim of visible parts of radio equipment such as external antennas and mounts results in losses, damage and even theft, the latter generated by knowledge that visible equipment points to non-visible equipment obtainable by breaking and entering a conveyance. Instrinsic problems include inability to obtain and maintain the quality of radio frequency ground that is all important for satisfactory receiving and transmission. Since transmission and receiving occur more often when a conveyance such as an automobile is in motion, poorly grounded equipment may well deteriorate to an inoperable ground. Again intrinsically, poorly assembled equipment contributes to the noises and rattling which are seemingly inherent in powered personal conveyances, noises which often defeat a driver's sensing of the usual sounds of a receiver as well as those of the road. Of course, one might overcome these intrinsic problems by using one piece, rigidly attached, nonseparable equipment but the visibility of such equipment certainly will attract vandalism and theft as set forth heretofore.

The art has not been dormant in the stated area as evidenced by issued Patents, for example, U.S. Pat. Nos. 3,071,338; 3,169,739; 3,369,247; 3,555,551; 4,028,705 and 4,028,706. Although some of the aforesaid extrinsic and intrinsic difficulties are addressed by the inventions disclosed in these patents actual solutions have not readily been forthcoming. For example, although the invention in U.S. Pat. No. 4,028,705 employs a base member which slidably receives a metal body member the invention requires participation of a trunk lid to improve the all important ground connection. Another development in the art is embodied in a hinged member of a mount, the hinge being closed or opened as the case may be for use or storage of the mount. Such hinges provide unimproved radio frequency ground connections and are seldom free from extraneous noise.

It is in the aforesaid field and against the aforesaid background that the present invention has been conceived and embodied.

SUMMARY OF THE INVENTION

The invention provides a mount for the antenna of a two-way or civilian band (CB) radio, the mount being especially adapted for use on a conveyance having a coverable storage area such as an automobile with a trunk in the rear. In its nonassembled state the mount basically comprises three members. There is a base bar member with a generally right-angled configuration and having vertically adjustable tension fastener means at the lower end of its generally vertical arm and also on this arm a pair of laterally positioned claws or fingers for slidably receiving vertically a flat metal bar portion of another member, in this case an antenna mounting bracket member. An additional feature of base member is the presence of two slots for vertical adjustment and subsequent attachment of the tension fastener means. A second member is a substantially U-shaped, channel bar member fitted on its upper arm with fastener means for attachment to the under side of a water runoff trough area of an automobile trunk. The lower arm of this bar member is fitted with two slots by which horizontal adjustment of the upper horizontal arm of the base member is accomplished whilst the upper arm of the U-shaped member is firmly fastened to the underside of the aforesaid runoff trough. The third member is an antenna mounting double-angled bracket member with a substantially upstanding configuration. This third member has a least one opening in its upper horizontally disposed arm for receiving an antenna and its coaxial cable. It also has a slot for positioning the cable as the cable makes its protected way from the antenna to the interior of the conveyance and finally to the transceiver. An additional feature of the antenna mounting bracket member is a holding element on its lower vertical arm, preferably in the shape of a lip for engaging a tension-latching element such as a strap or drawhook of fastener means. When preparing the antenna mount for use the U-shaped member is firmly fastened to the underside of a water runoff trough adjacent to a car trunk. Bolting means thru openings in the lower arm of the U-shaped member coupled with slots in the upper horizontally-disposed arm of the right-angled base member allow horizontal adjustment of this horizontal arm to conform it to the width of the runoff channel aside the trunk area. The lower vertically disposed end of the antenna mounting bracket member slides into and through the lateral claws of the base member and the fastener means are adjusted vertically in slots of the base member to permit proper positioning of the latching element of the tension fastener means on a latch-holding element of the antenna mounting bracket. The latter butts on an attachment plate of the fastener means. Lever action of the tension fastener means binds together the lower arm of the antenna mounting bracket to the lower arm of the base member to provide an improved radio frequency ground. The antenna mount is dissembled by moving the lever of the fastener means to disjoin the latching elements. Thereupon the bracket member, attached antenna and coaxial cable are slidably removed vertically for placement in the trunk of the automobile for safe concealment and storage.

A mobile antenna is grounded at its mounting base by a component which is integral with the antenna assembly or by grounding the outer shield of the antenna's coaxial cable. The present invention provides at least one mounting opening, preferably two openings in the upper horizontal arm of the mounting bracket for mounting antennas of different types some of which have integral grounding components. Additionally, the invention provides another opening for proximate grounding of an antenna which does not contain an integral grounding component.

DESCRIPTION OF THE PREFERRED EMBODIMENT

Figure 1:
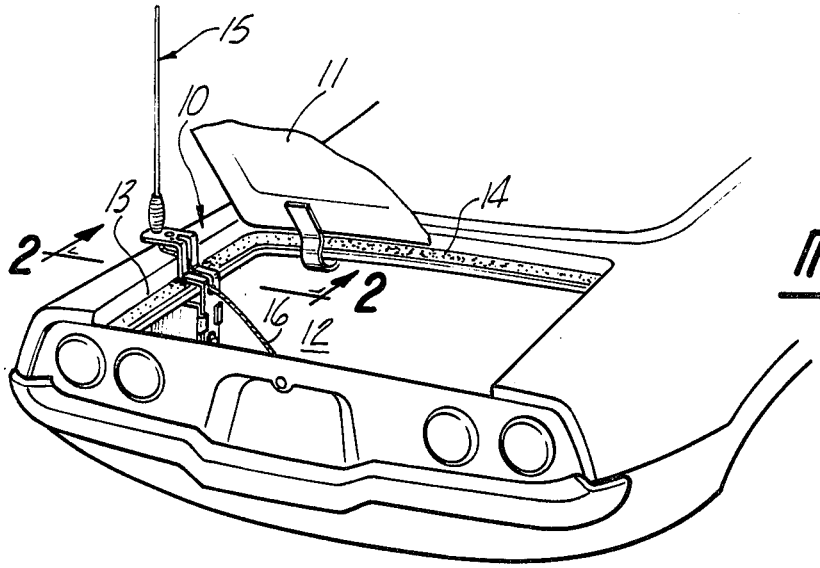
FIG. 1 is a perspective illustrating one use of the invention on a conveyance.
Figure 2:
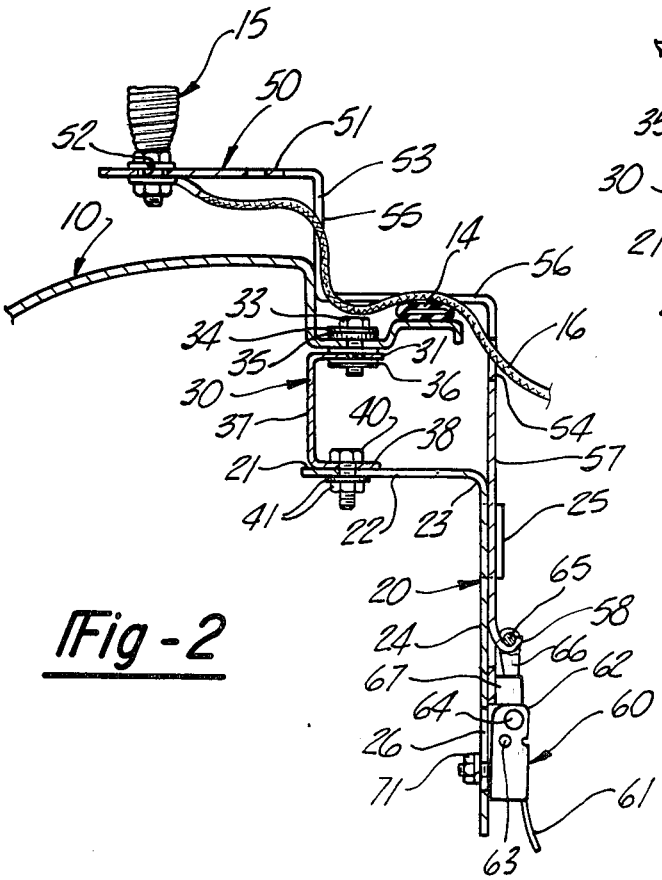
FIG. 2 is a section of the antenna mount as assembled in FIG. 1.
Figure 3:
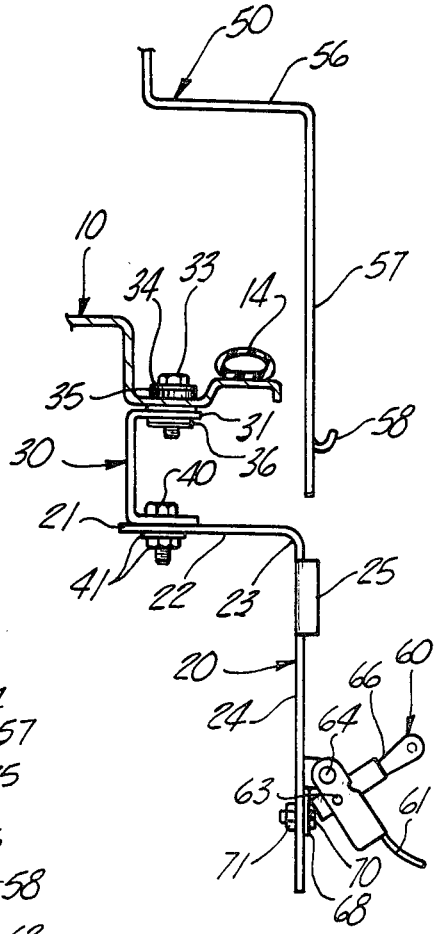
FIG. 3 is an exploded section of the antenna mount separated for concealment-storage of the antenna mounting upper member.
Figure 4:
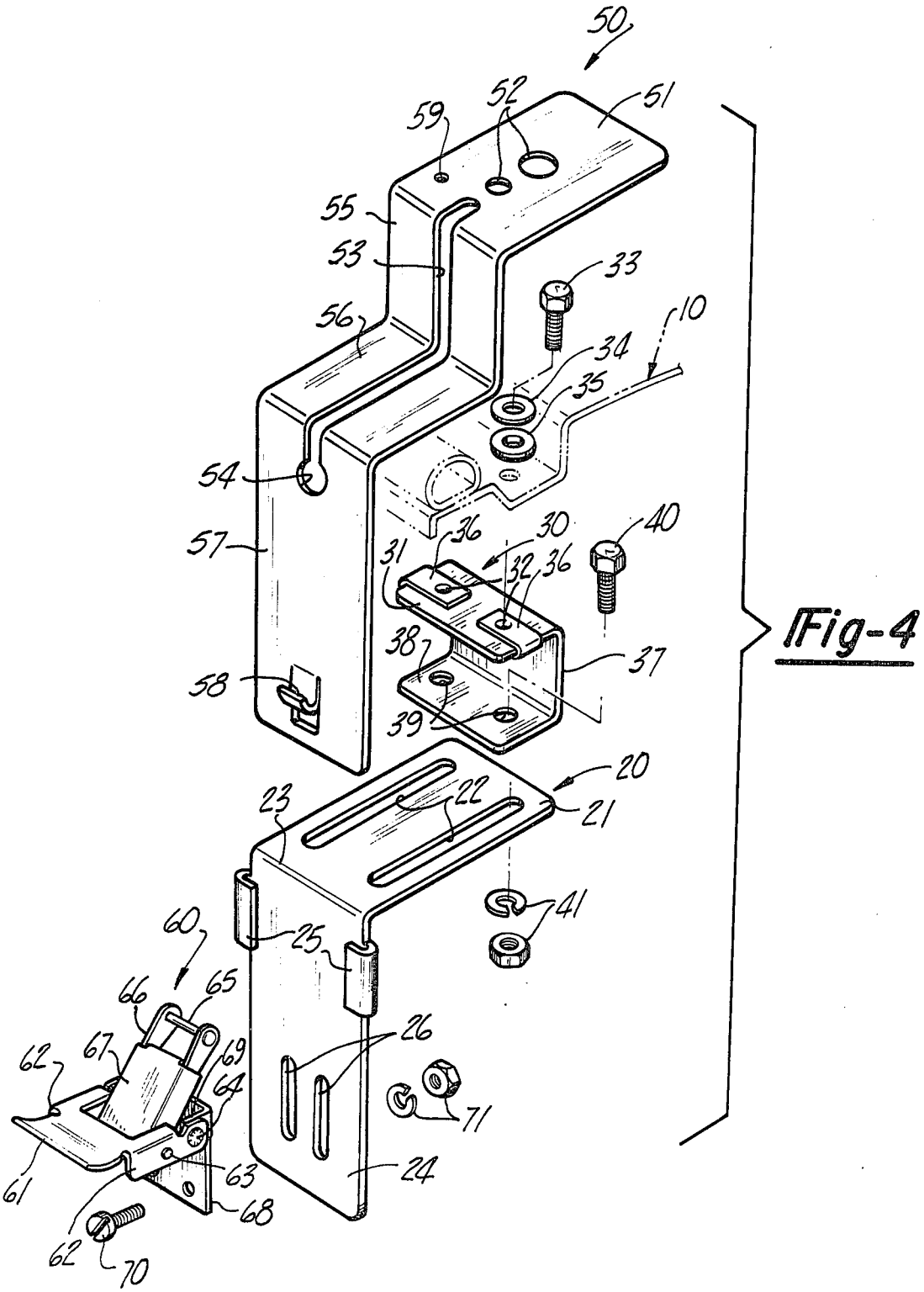
FIG. 4 is an exploded perspective of all components of the antenna mount.

A drawing of the invention as conceived and embodied in its preferred form shows the left rear body panel 10 of an automobile which is provided with a trunk lid 11 for exposing and covering the trunk storage area 12. A laterally positioned water runoff trough 13 is adjacent to a resilient sealing strip 14 often of a rubber similar material. Communications equipment such as a civilian band radio transceiver (CB radio transceiver) is normally positioned and concealed within a conveyance. However, optimum transmission and reception are obtained by locating the antenna 15 externally of the vehicle in a manner permitting the frequency-carrying coaxial cable 16 to run from the antenna to a location within the automobile conveyance where the transceiver is located.

The present invention allows the necessary external but proximal placement of the antenna for the proper utilization of the communications equipment. Subsequent to this utilization the visible part of the equipment is readily removed and concealed within the storage area 12. Installation of the various members of the adjustable separable antenna mount in assembled relationship starts with the raising of the trunk lid 11 to allow attachment of a clamping intermediate U-member 30 to the underside of the water runoff trough 13. Since the function of the runoff is to drain off water without allowing it to penetrate the storage area 12 the attachment means comprises openings 32 in the upper arm 31 of the U-shaped member 30 thru which threaded bolts 33 are positioned with plain washers 34 and rubber-like sealing washers 35. The attachment means preferably utilize Tinnerman nuts 36 through which the bolts are threaded to obtain firm attachment. In the lower horizontal arm 38 of the clamping intermediate member are two openings 39 for placement of bolts 40 which are held by lock washer-nuts 41, preferably Keps-nuts which provide a lock washer and nut as a unit. Since the upper arm 31 of the clamping intermediate member 30 is firmly attached to the underside of the runoff 13 the bolts 40 provide posts on which lateral adjustment horizontally of the upper arm 21 of a hold-down lower member 20 is accomplished in slots 22 as required by variable widths of the runoff 13. The hold-down lower member 20 is positioned on the post bolts 40, adjusted laterally horizontally in the slots 22 and firmly anchored by a tightening of the nuts 41. Thus, an assembler has a firmly affixed partial assembly comprises the joined clamping intermediate member and the holddown lower member.

To the latter the spring draw pull catch fastener 60 is loosely attached by inserting the bolts 70 of the fastener into and along the slots 26 of the vertical arm 24 of the hold-down member and finger tightening the lock washer nuts 71. Thus the plate 68 of the fastener is attached to the trunk side of the vertical arm of the hold-down member with the lever action handle 61 of the fastener in an easily accessible location for use. When so positioned the vertical arm 24 of the hold-down member 20 is ready to receive the lower vertical arm 57 of the antenna-mounting upper member 50 into and through the lateral claws 25 on the vertical arm 24. Vertical adjustment of the catch fastener 60 by proper manipulation and placement of its bolts 70 and tightening of the nuts 71 insure a fit between the trunk lid and the lower horizontal arm 56 of the mounting member 50 without deleterious compression of the sealing strip 14. Such manipulation and placement allows the strap 65 of the fastener 60 to engage the lip 58 of the lower vertical arm 57 of the mounting member 50. The lever action handle 61 of the fastener is then actuated to provide a tension latching effect which guarantees close contact between the vertical arm 24 of the hold-down member and the lower vertical arm 57 of the antenna mounting member. All members are now in working assembly relationship. A suitable antenna 15 with coaxial cable 16 is mounted on the upper horizontal arm 51 thru an opening 52. The cable is positioned in the slot 53 and enlarged end 54 to avoid more than minimal contact with a closed trunk lid. In the case of an antenna having a grounding component which is integral with the antenna base a separate grounding procedure is unnecessary. For an antenna requiring a separate grounding procedure an opening 59 in the mounting upper horizontal arm 50 is available for the required proximate grounding of an upper shield of the co-ax cable 16.

Disassembly easily follows release of the lever action handle 61 and vertically slidable removal of the lower vertical arm 57 of the antenna mounting upper member 50. Placement of the thus separated member and the antenna in the storage area 12 removes visible evidence of the presence of the communications equipment.

It will be observed that the preferred embodiment utilizes a substantially double right-angled antenna-holding upper member 50. However, the upper vertical arm thereof 55 is also operable as a generally upstanding arm forming an obtuse angle with the lower horizontal arm 56. Both a right-angled and an obtuse-angled upper vertical arm position the antenna in a configuration sufficiently external to a conveyance for optimum operation. Similarly, the horizontal lower vertical arm 56 is operable by slight adjustment of its plane to conform to a step or steps in the runoff trough 13. It is preferred that the base, intermediate and upper members be of 14 gauge sheet metal which is coating plated. The preferred spring draw pull catch which provides the tension latching is commercially available under the name Nielsen. As will be apparent to those of ordinary skill in the relevant art the various dimensions of the members, openings and slots are not critical. For most adaptations operable dimensions are: a hold-down lower member with an about 4.5 inch high by 2 inch wide vertical arm having about 1.4 inch slots and about 1 inch lateral claws; an about 2.5 inch long by 2 inch wide horizontal arm with about 1.4 inch slots; an intermediate clamping member of about 2 inch width with about 1 inch lower and upper arms and an about 1.5 inch upstanding arm, an antenna-mounting upper member with an about 2 inch width, a 5 inch lower vertical arm; a 2¼ inch lower horizontal arm, a 2 inch upper vertical arm and a 3 inch upper horizontal arm. The slot component of the latter member extending from approximately the inner end of the upper vertical arm to the upper end of the lower vertical arm is about ¼ inch in width and is about 4¾ inches in length. The two antenna mounting openings are about 0.6 inch and 0.4 inch in diameter respectively while the proximate grounding opening is about 3/16 inch in diameter. The preferred position for the engaging lip of the lower vertical arm of the antenna-mounting upper member is about 0.6 inch from the lower end of said arm. Other operable dimensions and combinations of dimensions will be apparent to those of skill in the art as will be other areas of placement of the mount on a mobile conveyance with a coverable storage area.

I claim:

1. A transceiver mount suitable for a conveyance having a coverable storage area comprising (A) a hold-down lower member formed of a substantially right-angled bar having on the lower end of its vertical arm vertically-adjustable, lever-operated tension fastener means for engaging a fixed reciprocal element on a contiguous vertical arm of another bar, having on the upper end of said vertical arm a pair of laterally positioned upright claws for slidably receiving said contiguous vertical arm and having on its horizontal arm a pair of slots for engaging post-bolt means (B) a clamping intermediate member formed of a substantially U-shaped bar whose upper arm has water-proofed bolting means for attachment to the under side of a lateral runoff trough adjacent to the rear coverable storage area of a conveyance and whose lower arm has post-bolt means for horizontally adjusting and bolting the horizontal arm of said hold-down lower member (A) and (C) an antenna-holding upper member formed of a double substantially right-angled bracket bar having (a) on its lower vertical arm fixed catching means for engaging a grasping element of the tension fastener means on the vertical arm of the hold-down member (A), (b) a substantially centrally positioned slot extending from the top of a lower vertical arm through a lower horizontal arm and an upper vertical arm and terminating at an inside end of an upper horizontal arm, (c) at least one opening in an upper horizontal arm for attachment of a transceiver antenna, and (d) one smaller opening in said upper horizontal arm for receiving a ground of co-ax cable element of said antenna.

2. The mount of claim 1 wherein the tension fastener means at the lower end of the vertical arm of the right-angled hold-down member is a spring draw pull catch and the fixed catching means on the lower vertical arm of the antenna-holding upper arm is formed as a lip for engaging the strap of the spring draw pull catch.

3. The mount of claim 1 wherein the upper horizontal arm of the double-angled antenna-holding member has two openings for mounting the transceiver antenna.

4. The mount of claim 2 wherein the vertical arm of the hold-down member has two parallel slots for vertical adjustment of the spring draw pull catch.

* * * * *